US007955447B2

(12) United States Patent
Jang et al.

(10) Patent No.: US 7,955,447 B2
(45) Date of Patent: Jun. 7, 2011

(54) GLASSY METAL COMPOSITE MATERIAL

(75) Inventors: Shian-Ching Jang, Kaohsiung County (TW); Chih-Ching Huang, Kaohsiung County (TW); Chih-Chiang Fu, Kaohsiung County (TW); Jia-Yu Ciou, Kaohsiung County (TW); Liang-Jan Chang, Kaohsiung County (TW)

(73) Assignee: I Shou University (TW)

( * ) Notice: Subject to any disclaimer, the term of this patent is extended or adjusted under 35 U.S.C. 154(b) by 355 days.

(21) Appl. No.: 12/177,510

(22) Filed: Jul. 22, 2008

(65) Prior Publication Data

US 2009/0246549 A1 Oct. 1, 2009

(51) Int. Cl.
*C22C 45/00* (2006.01)

(52) U.S. Cl. ..... 148/403; 148/420

(58) Field of Classification Search ..... 148/403
See application file for complete search history.

(56) References Cited

U.S. PATENT DOCUMENTS 6,669,899 B2 * 12/2003 Bae et al. ..... 419/38

FOREIGN PATENT DOCUMENTS

JP 2007/092103 A * 4/2007

OTHER PUBLICATIONS

J. S. C. Jang and J. Y. Ciou et al., "Enhanced mechanical performance of Mg metallic glass with proous Mo particles", Applied Physics Letters 92, 011930 (2008).

* cited by examiner

*Primary Examiner* — George Wyszomierski
(74) *Attorney, Agent, or Firm* — Brooks Kushman P.C.

(57) ABSTRACT

A glassy metal composite material includes: a Mg-based amorphous metal matrix; and a plurality of porous metal particles dispersed in the Mg-based amorphous metal matrix. The Mg-based amorphous metal matrix penetrates into pores in the porous metal particles. The porous metal particles have a hardness less than that of the Mg-based amorphous metal matrix.

6 Claims, 4 Drawing Sheets

GLASSY METAL COMPOSITE MATERIAL

BACKGROUND OF THE INVENTION

1. Field of the Invention

This invention relates to a glassy metal composite material, more particularly to a glassy metal composite material including a plurality of porous metal particles dispersed in an amorphous metal matrix.

2. Description of the Related Art

Compared to Pd-based and Zr-based glassy metals, Mg-based glassy metals have an advantage of a relatively low density, but have undesired intrinsic brittleness at room temperature. In addition, when an external compression stress is applied on the Mg-based glassy metal, the Mg-based glassy metal is likely to fracture prior to a yield point thereof due to its intrinsic brittleness.

There are two known methods for improving ductility of the Mg-based glassy metal by addition of secondary phase particles into a matrix of the Mg-based glassy metal. One is conducted through addition of particles with a hardness less than that of the matrix, which is the so-called crack bridging model. The other is conducted through addition of particles with a hardness higher than that of the matrix, which is the so-called crack deflection model.

D. G. Pan et. al. (Applied Physics letters, 89, 261904, 2006) disclose addition of 8 vol % Nb particles having a particle diameter ranging from 20 μm to 50 μm into a $Mg_{65}Cu_{20}Ag_5Gd_{10}$ matrix so as to improve the ductility thereof. The result of stress/strain relation (not shown) shows that an engineering strain of up to 18% can be achieved, but an elastic strain at an initial stress-provided state is merely up to 2%.

Ying-Kun Xu et. al. (Acta Material 53, 2005, 1857-1866) disclose addition of 10%-30% vol $TiB_2$ particles having a particle diameter of 10 μm into a $Mg_{65}Cu_{7.5}Ni_{7.5}Zn_5Ag_5Y_{10}$ matrix so as to improve the ductility thereof. The result of stress/strain relation (not shown) shows that compression strength and elastic strain are about 1.3 MPa and about 4%, respectively. However, propagations of shear bands extend along peripheries of the $TiB_2$ particles during compression, which results in fracturing of the matrix prior to yield point and in a decrease in absorbing failure energy within the matrix.

SUMMARY OF THE INVENTION

Therefore, an object of the present invention is to provide a glassy metal composite material that can overcome the aforesaid drawbacks associated with the prior art.

According to the present invention, the glassy metal composite material comprises: a Mg-based amorphous metal matrix; and a plurality of porous metal particles dispersed in the Mg-based amorphous metal matrix. The Mg-based amorphous metal matrix penetrates into pores in the porous metal particles. The porous metal particles have a hardness less than that of the Mg-based amorphous metal matrix.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1B:
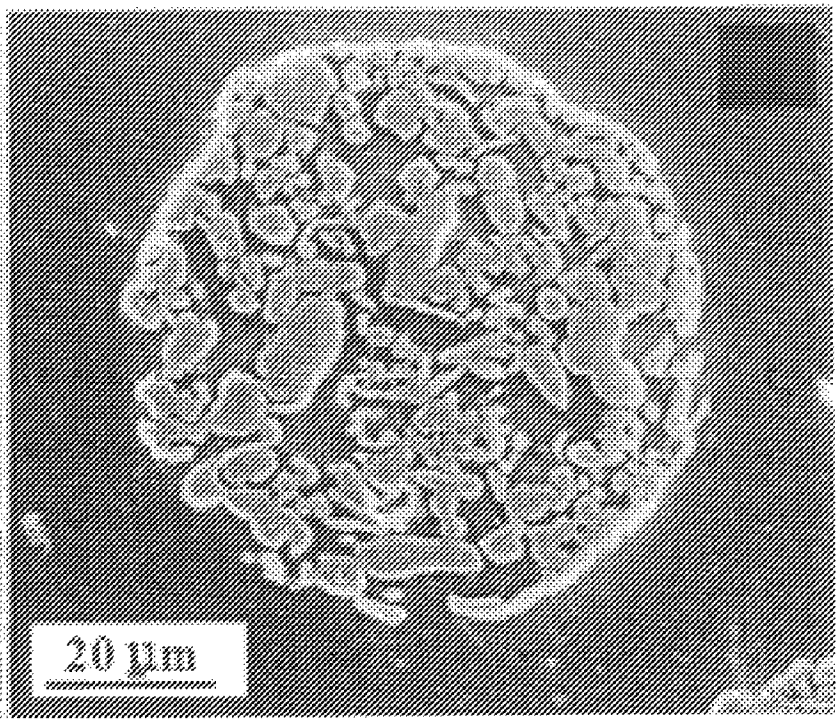
FIGS. 1*a* and 1*b* are scanning electron microscope images of the glassy metal composite material of Example 3 according to the invention.

The preferred embodiment of a glassy metal composite material of this invention includes: a Mg-based amorphous metal matrix; and a plurality of porous metal particles dispersed in the Mg-based amorphous metal matrix. The Mg-based amorphous metal matrix penetrates into pores in the porous metal particles, thereby enhancing bonding strength therebetween and forming multiple barriers at an interface therebetween for preventing propagation of shear bands within the Mg-based amorphous metal matrix. The porous metal particles have a hardness less than that of the Mg-based amorphous metal matrix.

Note that formation of the glassy metal composite material is conducted through addition of the porous metal particles into a melt of the Mg-based amorphous metal matrix.

Preferably, the Mg-based amorphous metal matrix is an inorganic-based material. Preferably, the porous metal particles have properties, such as high melting point, good heat-resistance, and inorganic acid resistance.

Preferably, the porous metal particles and the Mg-based amorphous metal matrix are immiscible and do not react with each other.

Preferably, the porous metal particles are made from a metallic material selected from the group consisting of Mo, Cr, Fe, Nb, and combinations thereof. In this embodiment, the porous metal particles are made from Mo.

It is noted that when the bulk porosity or the average particle diameter of the porous metal particles is too low, the number of the barriers formed at the interface between the Mg-based amorphous metal matrix and the porous metal particles would be insufficient. On the other hand, when the bulk porosity or the average particle diameter of the porous metal particles is too high, the desired properties contributed from the Mg-based amorphous metal matrix for the glassy metal composite material would be insufficient. In addition, when the amount of the porous metal particles is too low, a desired plastic deformation of the glassy metal composite material cannot be achieved. On the contrary, when the amount of the porous metal particles is too high, the desired properties contributed from the Mg-based amorphous metal matrix for the glassy metal composite material would be insufficient.

Preferably, the porous metal particles have a bulk porosity ranging from 25 to 35%.

Preferably, the porous metal particles have an average particle diameter ranging from 20 μm to 70 μm.

Preferably, the porous metal particles are in an amount ranging from 10 to 25% by volume based on a total volume of the glassy metal composite material.

Preferably, the Mg-based amorphous metal matrix has a composition including Mg, Cu, Gd, and Ag.

Preferably, the Mg, Cu, Gd, and Ag of the composition of the Mg-based amorphous metal matrix are in amounts ranging from 55 to 61 atomic ratio (at %), ranging from 27.5 to 29.5 atomic ratio, ranging from 10 to 12 atomic ratio, and ranging from 2 to 3 atomic ratio, respectively. In this embodiment, the amorphous metal matrix has a formula of $Mg_{58}Cu_{28.5}Gd_{11}Ag_{2.5}$.

The merits of the glassy metal composite material of this invention will become apparent with reference to the following Examples and Comparative Example.

EXAMPLE

Example 1

A Cu—Gd alloy ingot casting was prepared using electric arc techniques. The Cu—Gd alloy ingot casting was cut into small segments, each being melted so as to form an alloy melt using a high-frequency induction generation oven. Mg, Ag and porous metal particles of Mo (Elecmat Inc.) were added into the alloy melt so as to form a Mg—Cu—Gd—Ag melt including the porous Mo particles therein. During addition of the porous Mo particles, the high frequency induction generation oven was operated under a vacuum of $10^{-2}$ torr. Note that the oven was purged with Ar gas for three to four times so as to create an inert gas environment of $10^{-2}$ torr in the oven. The Mg—Cu—Gd—Ag melt thus formed was mechanically stirred under a speed of 20 rpm so that pores of the porous Mo particles were filled with the matrix. Subsequently, the Mg—Cu—Gd—Ag melt including the porous Mo particles therein was put into a water-cooled copper mold so as to form an ingot casting of the glassy metal composite material. The Mo porous particles added into the alloy melt were in an amount of 10 vol % based on a total volume of the glassy metal composite material.

Example 2

The process conditions of Example 2 were similar to those of Example 1, except that the porous Mo particles employed were in an amount of 15 vol % based on a total volume of the glassy metal composite material.

Example 3

The process conditions of Example 3 were similar to those of Example 1, except that the porous Mo particles employed were in an amount of 20 vol % based on a total volume of the glassy metal composite material.

Example 4

The process conditions of Example 4 were similar to those of Example 1, except that the porous Mo particles employed were in an amount of 25 vol % based on a total volume of the glassy metal composite material.

Comparative Example 1

The process conditions of Comparative Example 1 were similar to those of Example 1, except that the glassy metal composite material was not added with the porous Mo particles.

Figure 1A:
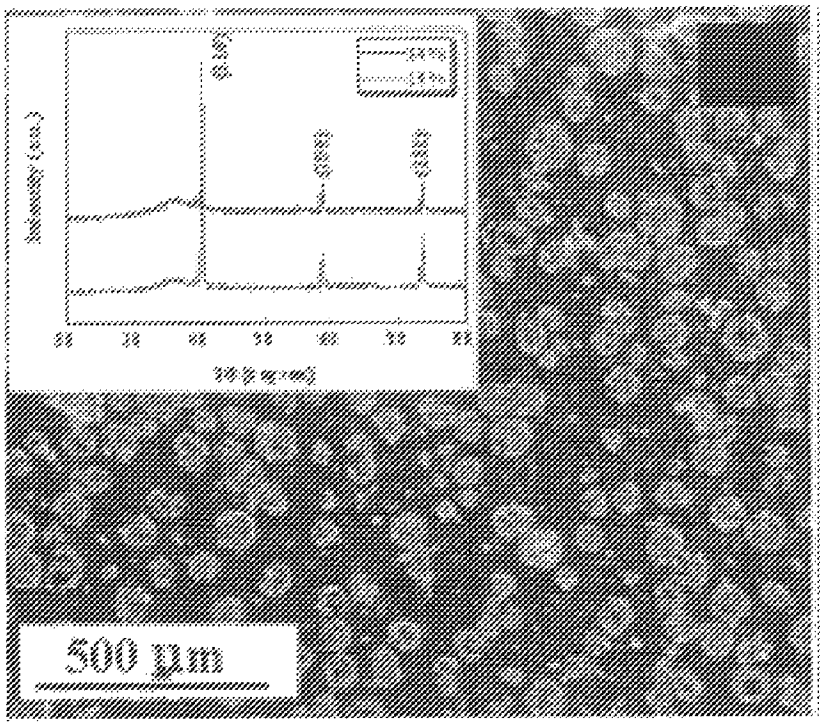

FIGS. 1*a* and 1*b* are scanning electron microscope images showing morphology of the glassy metal composite material of Example 3. The results show that pores of the porous Mo particles are filled with the matrix. In addition, an X-ray diffraction graph (indicated by illustration shown in FIG. 1*a*) shows the presence of the porous Mo particles in the matrix.

Figure 2:
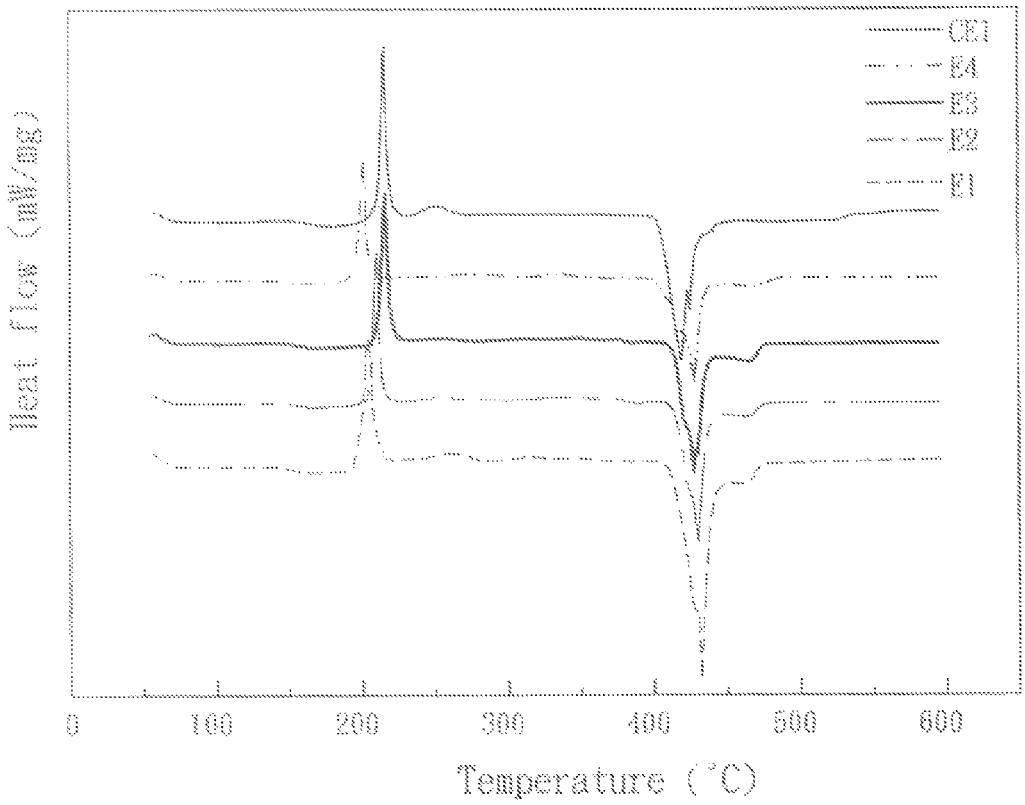
FIG. 2 is a Differential Scanning Calorimeter diagram of Examples 1 to 4 and Comparative Example 1.
Figures 3A, 3B, 3C, 3D:
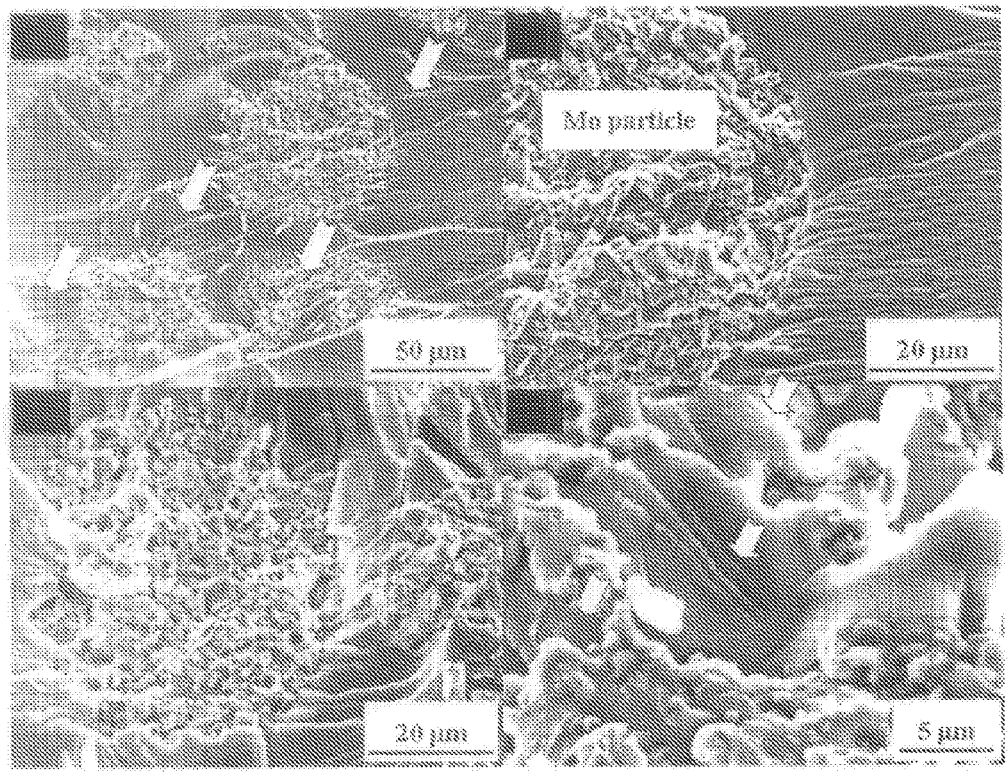
FIGS. 3*a* to 3*d* are backscattered electron images of Example 3.

FIG. 2 is a Differential Scanning Calorimeter diagram showing heat flows for Examples 1 to 4 and Comparative Example 1. The results show that no additional heat flow peak (i.e., additional chemical reaction) is present during mixing of the porous Mo particles with the matrix, which indicates that the glass forming ability of the matrix was not adversely affected.

Mechanical Test

The ingot casting of the glassy metal composite material was further re-melted in a quartz tube and injected into the water-cooled copper mold using injection-casting techniques so as to form rod-like specimens that are 2 mm in diameter and 4 mm in length.

The rod-like specimens of the glassy metal composite material were subjected to compression tests using a compression test machine (MST-810) under room temperature and a strain rate of $5\times10^{-4}$/sec.

FIGS. 3*a* to 3*d* are backscattered electron images of the glassy metal composite material of Example 3 after the compression test. The results show that a plurality of shear bands (indicated by the arrows in FIGS. 3*a* and 3*d*) are formed in the matrix, and penetrate into and terminate at the inside of the porous particles (see FIG. 3*d*). The shear bands thus formed do not propagate through or bypass the porous particles along peripheries thereof. The results show an improvement in plasticity of the glassy metal composite material.

Figure 4:
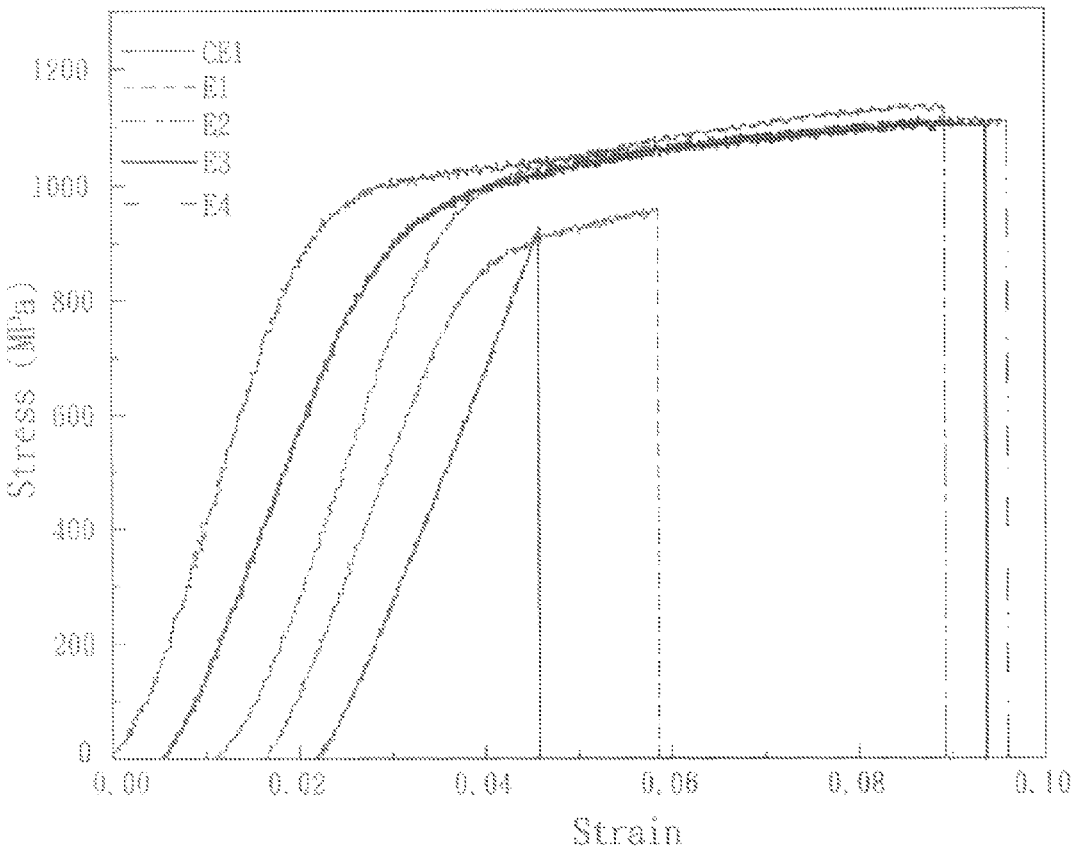
FIG. 4 is a plot showing stress/strain relation of Examples 1 to 4 and Comparative Example 1.

FIG. 4 is a plot showing stress/strain relation. The mechanical tests of Examples 1 to 4 and Comparative Example 1 are shown in Table 1.

TABLE 1

| | Amount of the porous metal particles (vol %) | Elastic Strain (%) | Plastic strain %) | Compression strength (MPa) |
|---|---|---|---|---|
| E1 | 10 | 2.4 | ~5.8 | 940 |
| E2 | 15 | 2.7 | ~9 | 1130 |
| E3 | 20 | 2.5 | ~9.35 | 1090 |
| E4 | 25 | 2.2 | ~9.6 | 1100 |
| CE1 | 0 | 2.0 | ~0 | 850 |

The results show that addition of the porous Mo particles can improve the plasticity of the glassy metal composite material.

By dispersing the porous metal particles into the Mg-based amorphous metal matrix, the aforesaid drawbacks associated with the prior art can be eliminated.

With the invention thus explained, it is apparent that various modifications and variations can be made without departing from the spirit of the present invention. It is therefore intended that the invention be limited only as recited in the appended claims.

What is claimed is:

1. A glassy metal composite material comprising:

a Mg-based amorphous metal matrix; and a plurality of porous metal particles dispersed in said Mg-based amorphous metal matrix;

wherein said Mg-based amorphous metal matrix penetrates into pores in said porous metal particles;

wherein said porous metal particles have a hardness less than that of said Mg-based amorphous metal matrix; and wherein said porous metal particles have a bulk porosity ranging from 25 to 35%.

2. The glassy metal composite material of claim 1, wherein said porous metal particles are made from a metallic material selected from the group consisting of Mo, Cr, Fe, Nb, and combinations thereof.

3. The glassy metal composite material of claim 1, wherein said porous metal particles have an average particle diameter ranging from 20 μm to 70 μm.

4. The glassy metal composite material of claim 1, wherein said porous metal particles are in an amount ranging from 10 to 25% by volume based on a total volume of said glassy metal composite material.

5. The glassy metal composite material of claim 1, wherein said Mg-based amorphous metal matrix has a composition including Mg, Cu, Gd, and Ag.

6. The glassy metal composite material of claim 5, wherein said Mg, Cu, Gd, and Ag are in amounts ranging from 55 to 61 atomic ratio, ranging from 27.5 to 29.5 atomic ratio, ranging from 10 to 12 atomic ratio, and ranging from 2 to 3 atomic ratio, respectively.

* * * * *